United States Patent [19]

Auraen

[11] Patent Number: 5,033,908

[45] Date of Patent: Jul. 23, 1991

[54] EQUIPMENT AND METHOD FOR POSITIONING CONSTRUCTIONS ON THE SEAFLOOR OR ON MAINLAND

[75] Inventor: Einar Auraen, Oslo, Norway

[73] Assignee: Multiconsult A/S, Lysaker, Norway

[21] Appl. No.: 488,015

[22] PCT Filed: Nov. 2, 1988

[86] PCT No.: PCT/NO88/00082

§ 371 Date: Jul. 3, 1990

§ 102(e) Date: Jul. 3, 1990

[87] PCT Pub. No.: WO89/04401

PCT Pub. Date: May 18, 1989

[30] Foreign Application Priority Data

Nov. 5, 1987 [NO] Norway ..... 874619

[51] Int. Cl.[5] ..... E02B 17/00

[52] U.S. Cl. ..... 405/204; 405/195; 405/227

[58] Field of Search ..... 405/204, 202, 205, 227; 166/366, 360, 362, 365, 368, 369

[56] References Cited

U.S. PATENT DOCUMENTS

| | | | |
|---|---|---|---|
| 3,605,884 | 9/1971 | Brown | 166/360 |
| 3,710,580 | 1/1973 | Mott | 405/202 |
| 3,714,788 | 2/1973 | Mott | 405/205 |
| 4,273,470 | 6/1981 | Blomsma et al. | 405/202 |

FOREIGN PATENT DOCUMENTS

| | | | |
|---|---|---|---|
| 0078309 | 4/1987 | Japan | 405/227 |

*Primary Examiner*—Dennis L. Taylor
*Attorney, Agent, or Firm*—Wenderoth, Lind & Ponack

[57] ABSTRACT

A system for positioning and mounting a large structure over a template lying on the ground or on the seafloor, uses a guide ring and a guide slot, both fixed to the structure, for guiding and holding onto two docking piles during a mating operation. These piles have been driven or drilled down into the seafloor/ground in advance through guide members fixed to the template.

12 Claims, 9 Drawing Sheets

EQUIPMENT AND METHOD FOR POSITIONING CONSTRUCTIONS ON THE SEAFLOOR OR ON MAINLAND

BACKGROUND OF THE INVENTION

The present invention relates to a method and apparatus for positioning and mounting large installations on the seafloor or on mainland.

Examples of such positioning/mounting operations are the mating operation for a large offshore structure onto a previously mounted template on the seabed, or the mating of building-like structures onto a structure already standing on the ground, and where separately installed directing or docking piles are used. For reasons of simplicity, mainly seabed operations will be dealt with in the following.

A typical such mating operation may involve a supporting structure or "jacket" that is to be lowered down in order to be secured in a predetermined position on-/above a template or an equivalent structure. The jacket shall be maneuvered downwards so that docking sleeves suitable for use therewith can be threaded down onto docking piles which have been driven or drilled down into the seafloor around the template, in order that the jacket may be placed exactly in position over the template. Two conflicting requirements are always presented in connection with mating operations of this kind.

On the one hand, there exists a requirement that the horizontal deviation between jacket and template be as small as possible in relation to the completely ideal position, this in order to secure the subsequent tieback operation, i.e. the coupling together of conductor strings to the already completed wells (well heads) in the template.

On the other hand, one would like to have large horizontal clearances or tolerances in the guiding system, i.e. between the docking piles and the guiding or docking cylinders which are to be threaded down onto the piles in order to simplify and secure the operation itself, which operation is critical regarding weather, wave and current conditions.

Traditionally a compromise is made, and one selected tolerances in the guiding system to make the mating operation feasible within a specified "weather window" based upon statistics on such conditions.

The previously known techniques regarding such positioning and mating is principally based upon three systems, all using two or more docking piles to effect guidance both "sideways and directionally" during the mating operation. As previously mentioned, these piles have been installed in advance. They have been driven or drilled down into the seabed under guidance from guide members mounted for instance on the ends of the previously mounted template. Then the jacket is floated or hoisted in above these docking piles.

A) "Fixed" system: When hoisting the jacket down, an open cylinder, the docking sleeve, which is fixed to the jacket, is firstly guided down onto the corresponding one of the docking piles. Thereafter the jacket is rotated until the other docking sleeves are in position right above their corresponding docking piles. Then, the jacket is lowered down the last part of the way, until the jacket is standing in its position on the seabed.

B) "Active" system: This system is similar to the "fixed" system above; however, the docking sleeves are mounted loosely each in a respective fixed cylinder, i.e. the docking sleeves may be moved vertically. The loose docking sleeves are suspended by respective wires, and thus may be lowered individually down onto the corresponding docking piles. In this system there is a possibility of raising the docking sleeves again if necessary.

C) "Passive" system: This system is also similar to the previous one; however, the loose docking sleeves are not suspended by wires and therefore cannot be reraised.

The previously used systems are burdened with several drawbacks.

The ultimate and essential point is being able to achieve the joining together of the oil conductor strings belonging to the platform and the pipes protruding up through the template (i.e. the tieback operation). Because of the above-mentioned compromises, which must be made regarding tolerances in the dimensions of piles and sleeves as well as in the positions and angles thereof, angular deviations as well as deviations in position may become larger than advisable during the tieback operation. In other words, small tolerances for the tieback operation entail a greater risk when effecting the very critical mating operation, when using these prior art systems.

Moreover, with the known systems there exists a possibility that the parts may get stuck during the mating operation if the tolerances are exceeded. This may prove fatal.

As a secondary point, it should also be mentioned that the previously known sleeve system is always large and heavy, and in connection with these large steel structures it is also necessary to use corrosion preventing electrical systems of considerable size.

SUMMARY OF THE INVENTION

An object of the present invention is to obviate the drawbacks in the prior art so that the following advantages are gained.

The tolerances in connection with the tieback operation are radically improved.

The mating operation itself may be effected with a larger clearance, which simplifies the operation and makes it less critical. The mating operation is very critical per se, because the jacket is afloat during the operation and is exposed to changing weather conditions.

The present invention may employ a centering gimbal which is fixed by welding to each one of the docking piles. Such gimbals provide reduced local positional and angular deviations in relation to the guide members on the template when the piles are drilled down into and cemented to the seabed, compared to a pile without such a gimbal.

The preliminary analysis of the mating operation is simplified because the number of variables entering into the calculation is reduced, whereby the reliability of the analysis results may be increased. The traditional method of using long sleeves threaded down onto the piles results in a large number of possible combinations of stiffnesses, since the stiffness is changed the further down the sleeve is threaded onto the pile. There are also uncertainties in determining a single stiffness. When using the system in accordance with the present invention, only the stiffness of the pile itself is a variable parameter during the lowering of the sleeve, while the previous variations relating to the sleeve are eliminated.

There is achieved a weight reduction of the mating system of about 90% in relation to the sleeve systems used today.

As a consequence of this reduction in weight and surface area, a corresponding reduction of the number of corrosion preventing anodes is also achieved.

The production of the present system is clearly simpler than the conventional systems.

A further and apparent advantage of the system in accordance with the present invention is the cost savings which can be appreciated in connection with several of the items mentioned previously.

BRIEF DESCRIPTION OF THE DRAWINGS

The invention will be described in more detail below, referring to the enclosed drawings, in which.

DETAILED DESCRIPTION OF THE PREFERRED EMBODIMENTS

Figure 1A:
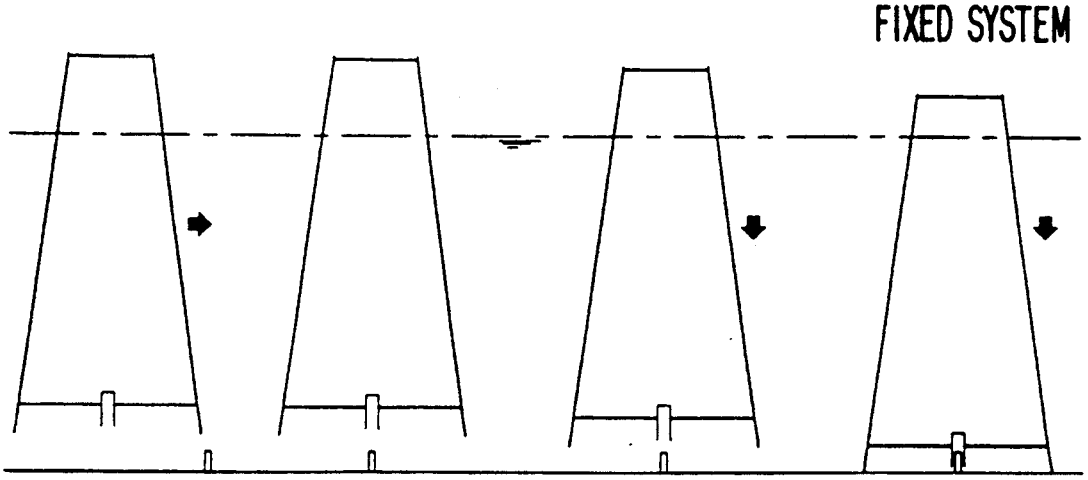
FIGS. 1*a*–1*c* are schematic diagrams of previously known mating systems.
Figure 1B:
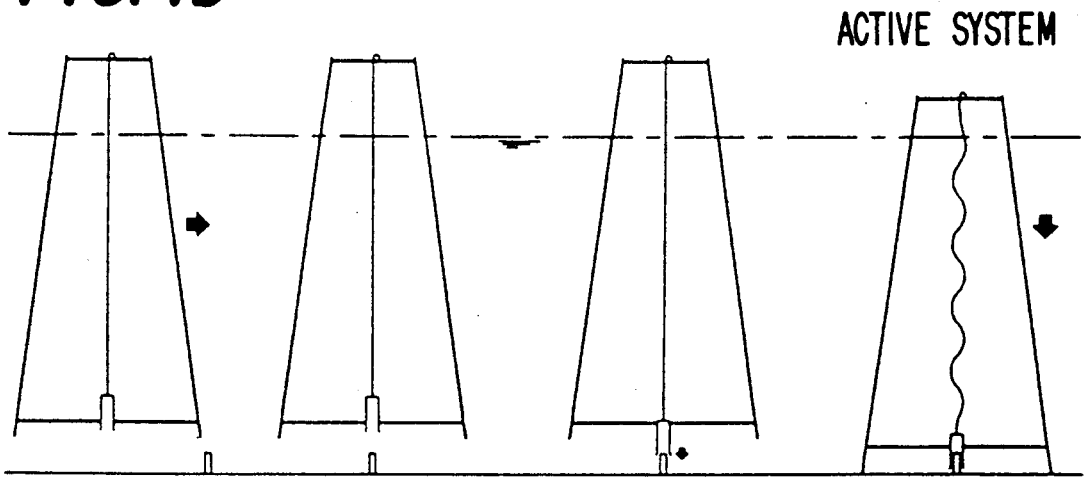
Figure 1C:
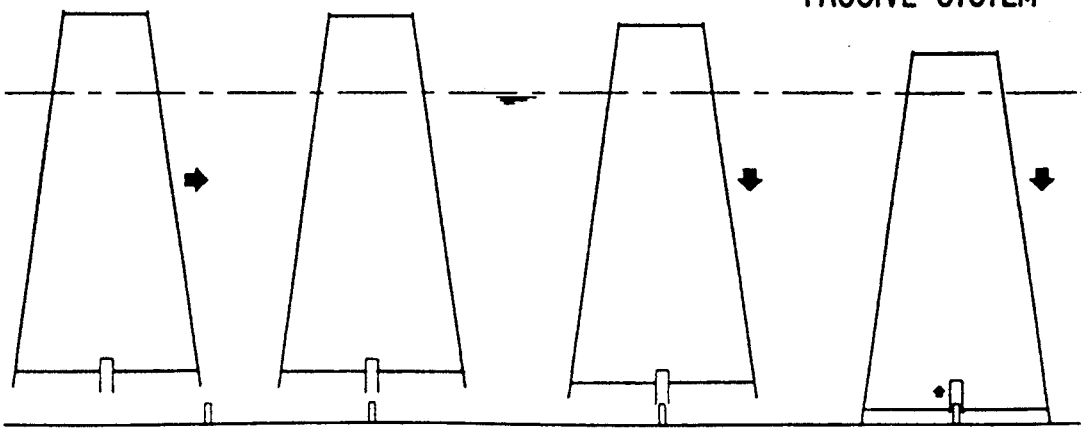
FIG. 1c (PRIOR ART)

In FIGS. 1*a*–1*c* there are shown previously known techniques of positioning large structures on the seafloor, as mentioned above. All three of the solutions which have been sketched are based upon the use of large sleeves which are threaded down onto docking piles in order to direct the structure into its position. The present invention does not depend upon such sleeves, as will become apparent from the description below.

Figure 2:
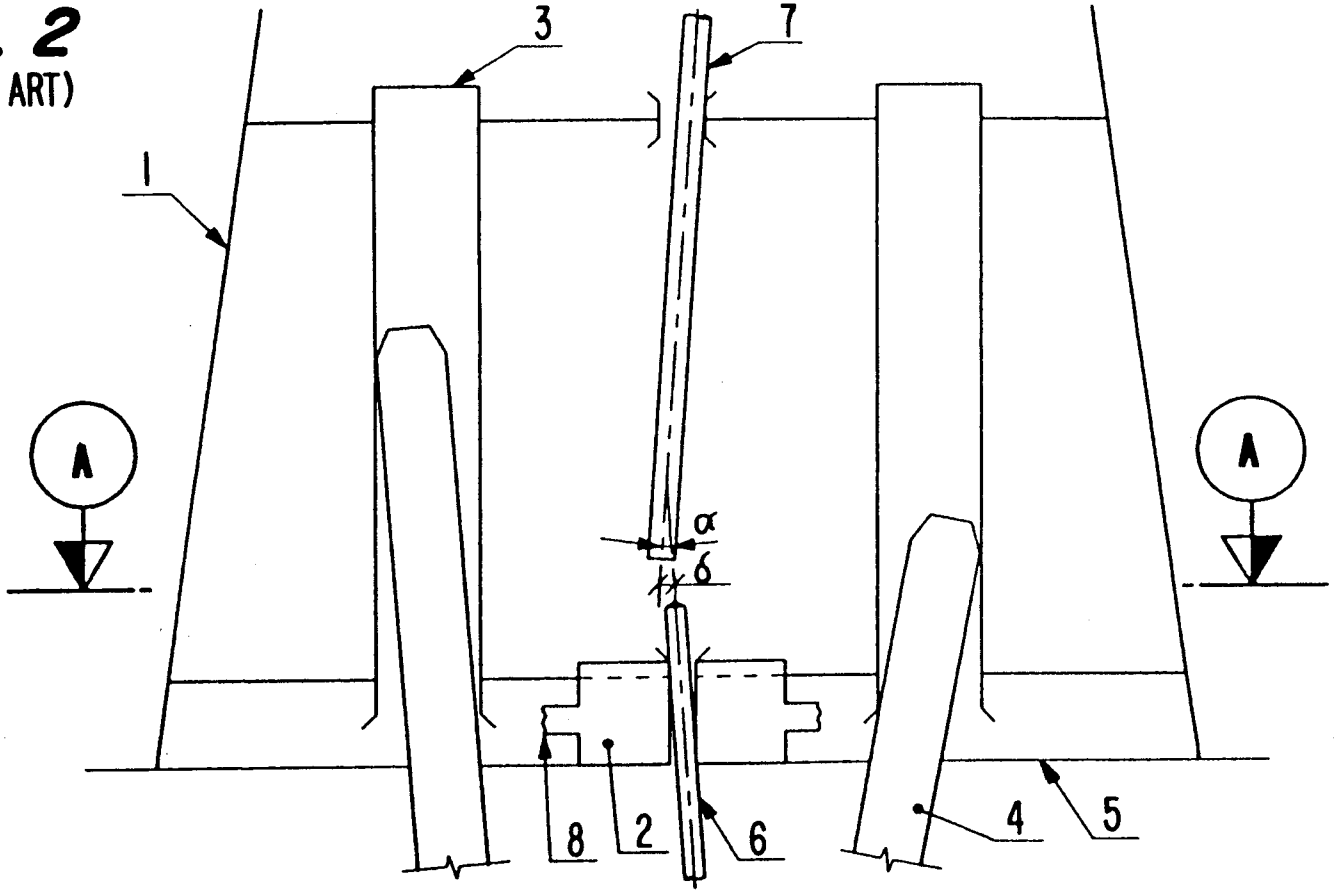
FIG. 2 (PRIOR ART)
FIG. 2 is a schematic diagram of a traditional system with fixed sleeves.

FIG. 2 also shows a traditional system using fixed sleeves 3, as in FIG. 1*a*. The angle a between the axes of the two pipes 6 and 7, as well as the sideways deviation $\delta$, are parameters to be minimized in connection with the tieback operation. The docking sleeves 3 are long cylinders extending between two lower portions of horizontal bracings of the structure 1, and they are threaded down onto docking piles 4. A frame or template 2 mounted on the seafloor forms a starting point for the installation of the piles 4 in the seafloor 5. Thereafter, guide members (not shown) are removed by burning and are hoisted away from the remaining stumps 8, so as to avoid transmitting the shock loads from the mating operation through the bottom template itself and thereby inflicting damage to the well heads.

Figure 3:
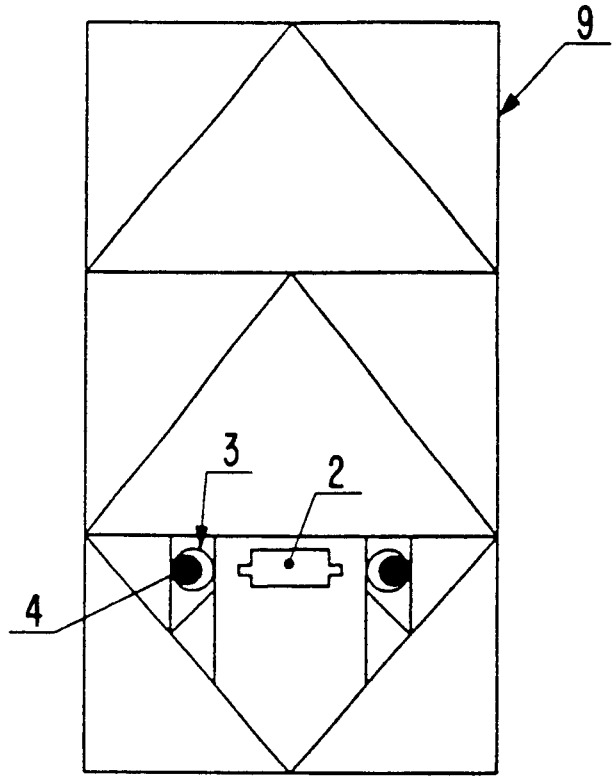
FIG. 3 (PRIOR ART)
FIG. 3 is a sectional view taken along line A—A in FIG. 2.

FIG. 3 is a plan view of the system of FIG. 2, or is a view along section line A—A in FIG. 2. The docking piles 4 are shown in black inside the sleeves 3.

Figure 4:
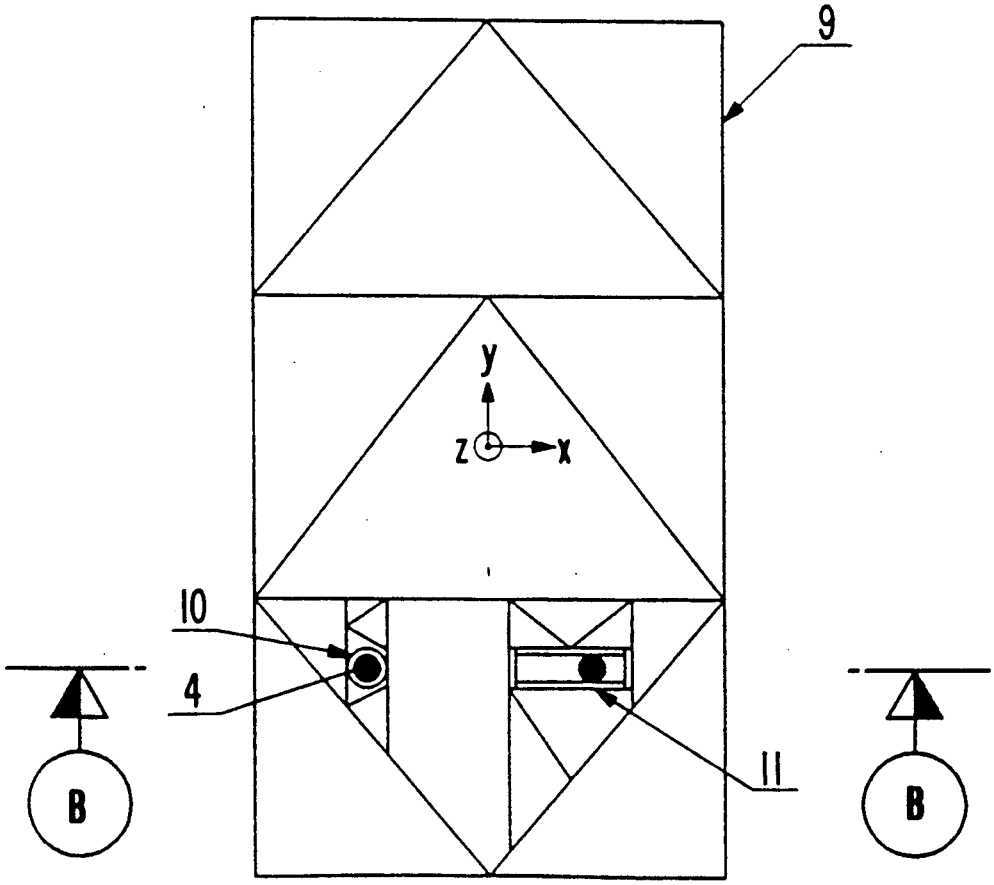
FIG. 4 is a view similar to FIG. 3 but of an embodiment of the positioning equipment in accordance with the present invention.

In FIG. 4 the central parts of the positioning equipment in accordance with the present invention are shown in a view similar to that of FIG. 3; however, the template has been left out for the sake of clarity. The docking piles 4 are also shown in black.

Figure 5:
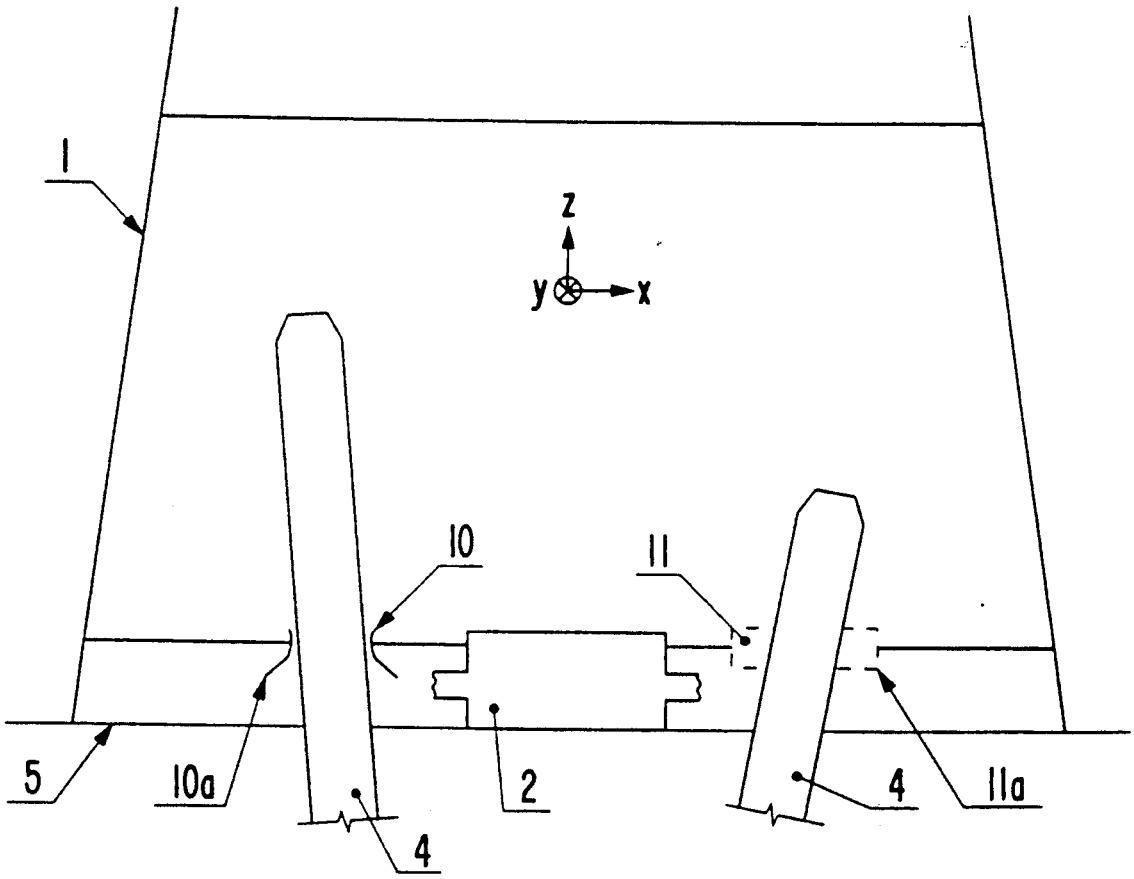
FIG. 5 is a schematic sectional view of the positioning equipment in accordance with the present invention as taken along line B—B in FIG. 4.

FIG. 5 is a side view of the positioning equipment. The central features of the invention are as follows.

Figure 6:
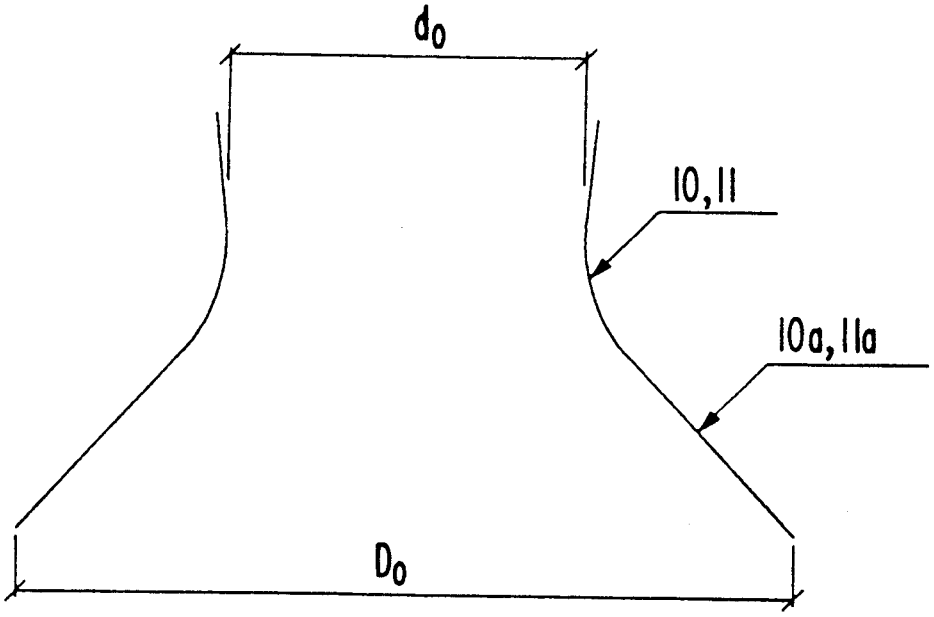
FIG. 6 is a cross-sectional view of a ring and slot in accordance with the invention.

The docking sleeves (3, FIGS. 2 and 3) have been exchanged for a guide ring 10 and a guide frame with a rectangular slot 11. The ring 10 and the slot 11 are in this case located in the same plane, for instance as shown in FIGS. 4 and 5, in the lower bracing. However, it is equally possible to dispose the ring and slot in respective horizontal planes, vertically spaced from each other. Furthermore the guide slot 11 is arranged in such a manner that its longitudinal center line is directed to the center of the ring 10. Both the ring and slot are suitably defined by downwardly opening directing parts for reception of the docking piles 4. Thus, the guide ring 10 comprises a conical directing collar 10*a* with a lower and larger diameter $D_0$, which directing collar gradually tapers in a curved manner to an upper part having a smaller ring diameter $d_0$, which upper part is fitted to the docking pile 4 (see FIG. 6). In a corresponding manner, the guide slot 11 is defined by a directing skirt 11*a*, which preferably has the same cross-sectional projected shape as the directing collar 10*a*, when viewing that section which is perpendicular to the above mentioned center line, in other words a view from the position of the guide ring 10. Thus, in this section one sees the same lower maximum opening $D_O$ and the same minimum opening $d_0$. The "ring" and "slot" mentioned hereafter without further explanatory statement shall be understood as the ring and the slot where the openings are the smallest. When constructing these minimum openings it is only necessary to take into consideration construction tolerances of the piles and guide parts.

By making the lower opening ($D_0$) of the directing parts 10*a*, 11*a* (see FIG. 6) sufficiently large, the requirement for maximizing horizontal clearances/tolerances in order to secure the installation operation within a given "weather window", is complied with. A value of this largest opening may be calculated from the "mating analysis", i.e. from the movement characteristics of the structure during the mating operation.

The system itself with ring 10 and slot 11 eliminates the consideration for horizontal deviation on top of the docking piles (because of vertical deviation on the pile itself). See FIG. 8 in connection with FIG. 9. From FIG. 9 the increased tolerances which must be taken into consideration by the traditional sleeve system appear clearly, the highest points of the docking piles possibly being erroneously placed within margins as sketched, having dimensions $d_1$, $d_2$, respectively. When using the present system including the ring and slot, such erroneously positioned points do not pose a problem, since the ring will slide along one of the piles while the slot will, at the same time, allow a sliding movement along the other pile, independent of angular errors. At the same time it should be noted that the angles in the drawings have been partly grossly exaggerated in order to clarify these considerations.

Thus, the present invention utilizes the fact that the ring arrests the structure from moving in the xy-plane, while the slot stops or establishes the limits on rotation of the structure in the same plane. As previously mentioned, the ring and slot may thereby be constructed as narrow as desired, i.e. it is only necessary to take into consideration the construction tolerances of the ring, slot and piles.

In a preferred embodiment of the invention the system is constructed in such a manner that that point of a docking pile 4 which is to have the smallest horizontal deviation relative to the template 2, will be situated in the same level as the narrowest horizontal plane in the respective ring 10 and slot 11 of the structure 1 when the latter stands in its final position, i.e. on the sea floor. This is tentatively illustrated in FIGS. 7*a* and 7*b*, in which in both cases the horizontal deviation shall be minimized in relation to the distance x', which represents the theoretically correct horizontal distance between a reference point 15 on the template 2 and an ideal position 14 of the docking pile 4.

Figure 7A:
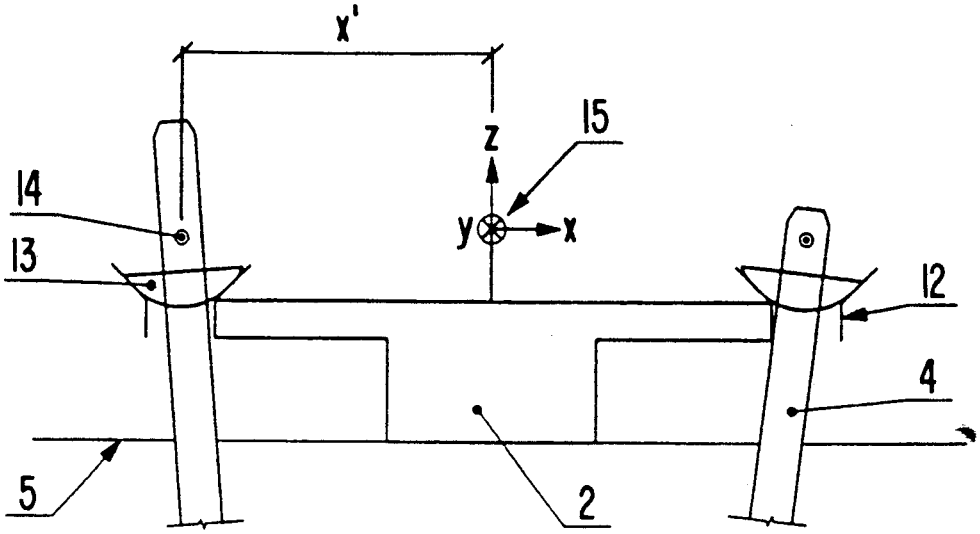
FIG. 7*a* is a schematic diagram of docking piles equipped with centering gimbals, in accordance with the invention, as well as the corresponding reference positions thereof.
Figure 7B:
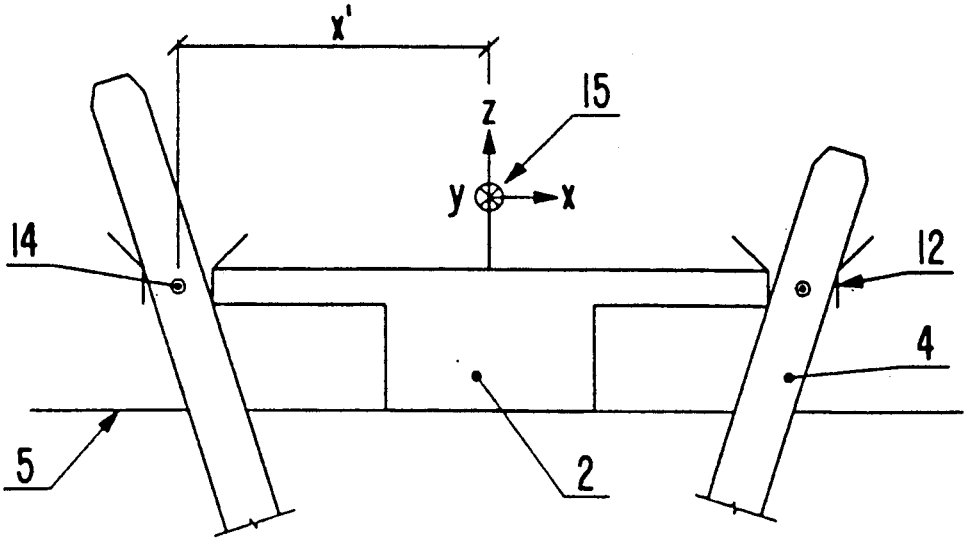
FIG. 7*b* is a similar view showing the above reference positions when using an alternative system without gimbals.

Thus, when looking at the arrangement according to FIG. 7*b*, the ring and slot shall in the end, i.e. when the structure 1 is standing on the seafloor 5, be disposed at the same level as the point 14. This requires of course that the guide members 12 have been removed prior to the mating operation, which removal is normally made by burning off and hoisting up the guide member 12 itself (see also FIG. 2, reference numeral 8).

The most preferred embodiment of the system according to the present invention is shown in FIG. 7*a*. Here the docking piles 4 have been equipped in advance with centering gimbals 13 which have been fixed by welding and are adapted to cooperate with the guide members 12. Such a centering gimbal provides a pile point 14 which deviates to an even lesser degree from its ideal position than the pile point 14 of FIG. 7*b*. Thus, in this manner it is possible to achieve a further reduction of the horizontal deviation in relation to the reference point 15. However, the welded gimbals 13 ensure that the guide members 12 cannot be hoisted up after burning. For this reason the guide members 12 are placed in a sufficiently high position on the template 2 that when burned off, they may fall down to the seafloor 5, thereby being brought such a distance from the parts of the structure 1 that when the latter is lowered down, said guide members 12 do not constitute an obstacle to the mating operation. It should be noted that loosely mounted gimbals are not always desirable, since these gimbals must be removed by means of some mechanical system. Furthermore it must be noted that FIG. 7*b* also shows guide members 12 in a high position, so that it is possible to utilize the advantage of merely dropping burnt-off guide members 12 down to the seafloor.

Thus, in the embodiment shown in FIG. 7*a*, the guide ring 10 and the guide slot 11 will be lowered down to the level indicated by the point 14, the structure 1 simultaneously reaching the seafloor 5. With the ring and slot in this level a minimum value of horizontal deviation is ensured. Accordingly it will be appreciated that the combination of features of the guide slot and guide ring, ensuring the positioning of the latter parts at the same level as the pile point 14 in question, as well as guide members located in a sufficiently high position and the use of centering gimbals, contribute to an essential decrease in the horizontal deviation possibly appearing between the structure 1 and the template 2. This is because that point 14 of a docking pile 4 which has the smallest horizontal deviation in relation to the template 2, determines the relative horizontal deviation for the structure 1 in relation to the template 2.

Figure 8:
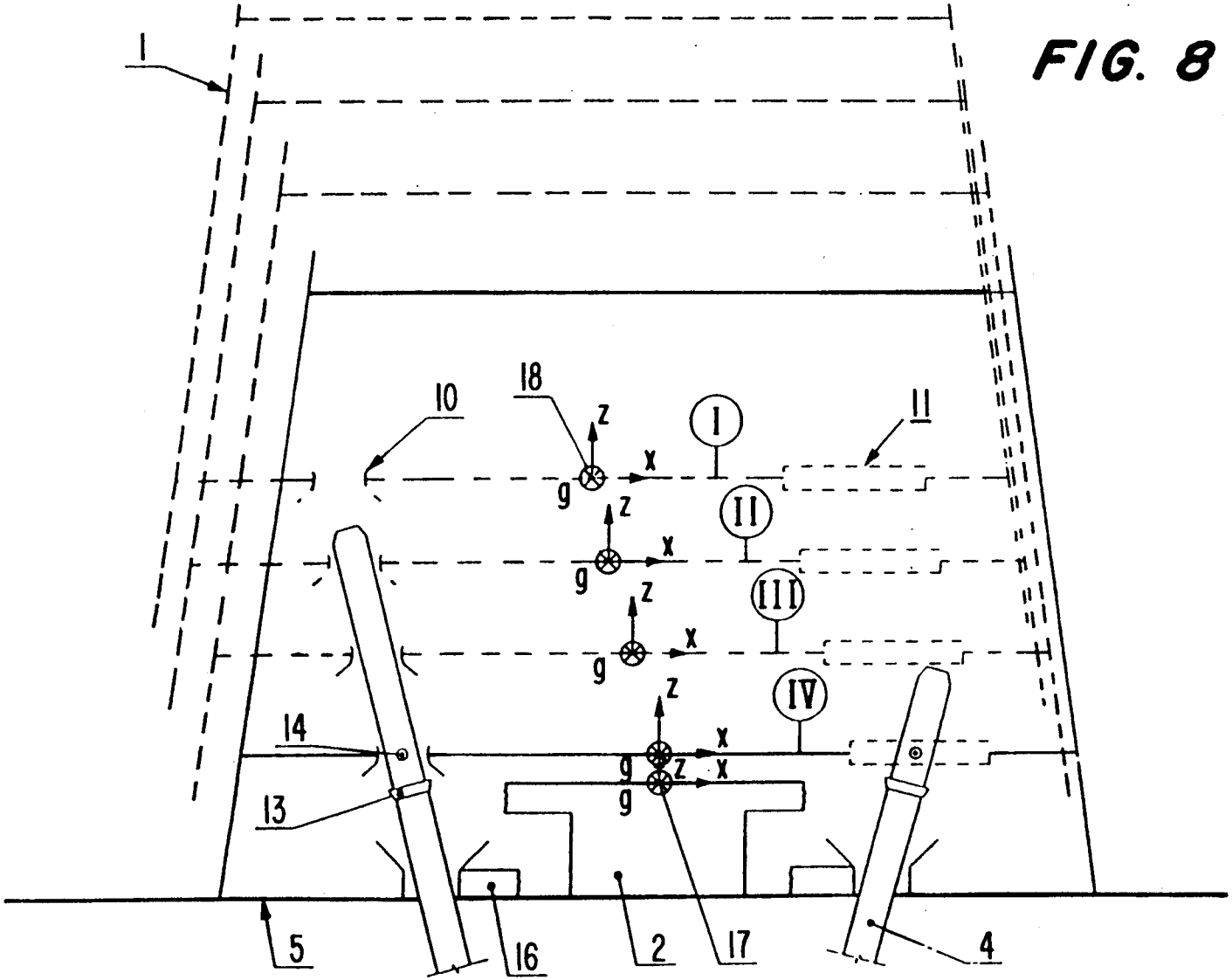
FIG. 8 is an explanatory diagram illustrating a sequence of different stages during a lowering operation in accordance with the invention.
Figure 9:
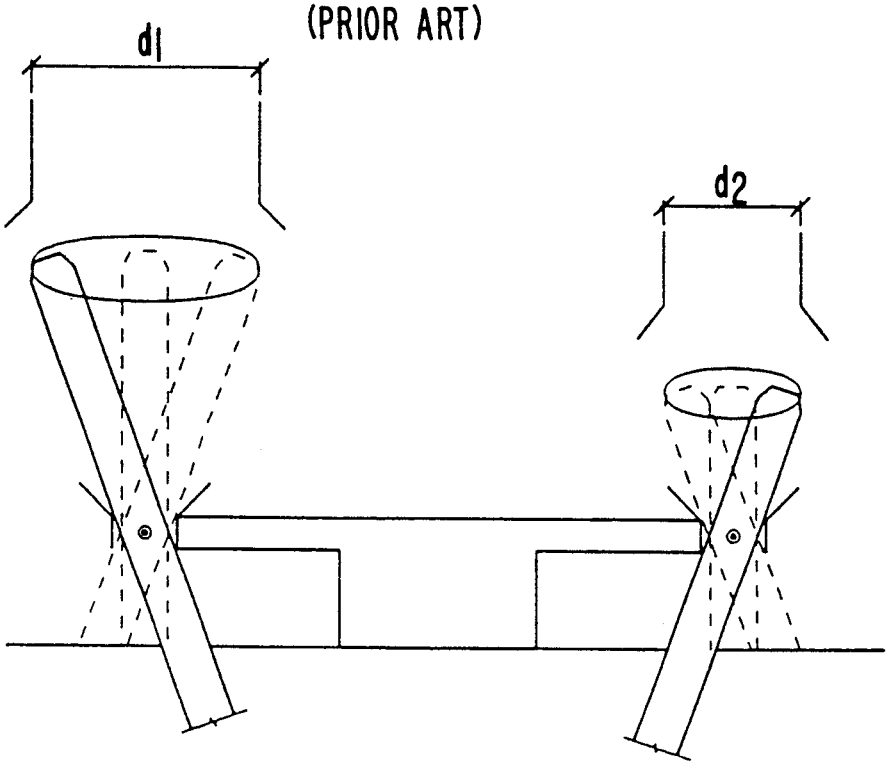
FIG. 9 (PRIOR ART)
FIG. 9 is an explanatory diagram illustrating a few of the sources of error which a traditional system must take into consideration.

FIG. 8 shows a sequence of the different stages of the mating operation. Docking piles 4 with gimbals 13 have been drilled down in advance. Thereafter, the guide members have been burned off, and the latter are now lying on the seafloor (see reference numeral 16). The structure 1 to be hoisted down is equipped in its lower bracing with the ring and slot, in line with what is shown in the preceding drawings. The ideal horizontal distance (x', see FIG. 7*a*) from the reference point 17 in the template 2 to the ideal position of point 14 above the centering gimbal 13 on pile 4, is found to be the distance from point 18 in the structure to the center of the ring. It is now a goal to bring point 18 into horizontal coincidence with point 17, i.e. point 18 is supposed to be finally located exactly vertically above point 17. From phase I, the structure 1 is lowered with the ring 10 down towards the top of the left-hand docking pile, the size of the lower opening of the directing collar 10*a* securing and simplifying this operation. The lowering down of the structure continues through phase II, the ring following the pile downwards with a small clearance therebetween. At the same time the structure 1 is now adjusted rotationally about the left pile, so that an accommodation of the slot (to the right in the figure) onto the right-hand pile is achieved. The directing skirt of the slot simplifies an allowance of small movements in the critical moment of the mating, i.e. just before phase III. During further lowering, the structure is guided by both ring and slot which are situated around their respective docking piles. When the lower parts of the structure touch the seafloor and stop, the ring and slot are located in the same level as point 14. The possible horizontal deviation now existing regarding point 18 in relation to point 17, is due to errors in the position of the center of the ring relative to the ideal position of point 14, for instance. As mentioned previously, these errors have now been minimized.

Figure 10A:
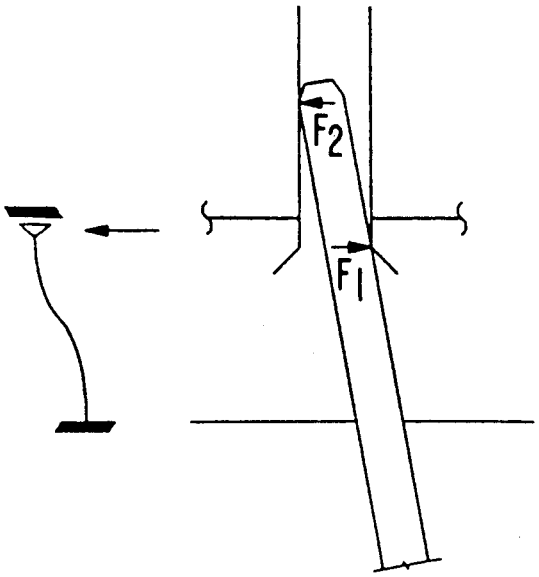
FIG. 10a (PRIOR ART)
FIG. 10*a* is a force diagram of the static system when using traditional equipment.
Figure 10B:
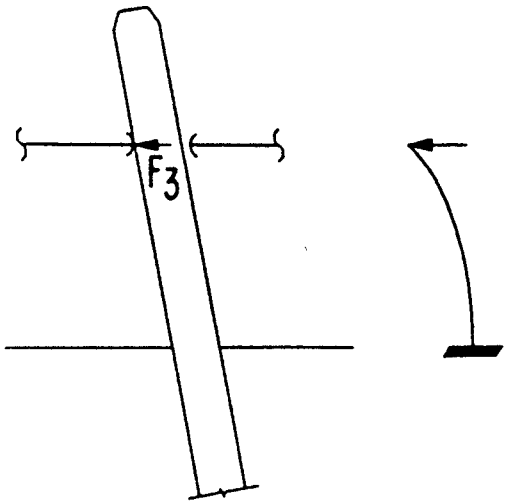
FIG. 10*b* is a similar diagram illustrating the static system when using the equipment in accordance with the invention.

In FIGS. 10*a* and 10*b*, a coarse and simplified comparison is shown between the traditional configuration with a sleeve and the configuration in accordance with the present invention, regarding the "static system". In the traditional configuration, (FIG. 10*a*) two engagement spots appear for a docking pile inside a docking sleeve, shown by arrows $F_1$ and $F_2$. In comparison, only one engagement spot appears in the configuration in accordance with the present invention, shown by the arrow $F_3$. The deformed condition of the docking pile in the two cases is shown symbolically at respective sides of the figures. Analytically, the configuration in accordance with the present invention (FIG. 10*b*) constitutes an essentially simplified system. As previously mentioned in this specification, the mating analysis comprises a number of variable parameters, for instance stiffnesses. The number of possible combinations of stiffnesses constitutes a problem since stiffnesses are changed as the sleeve slides further down onto the pile. In addition there exist uncertainties when determining a single stiffness. Since the system in accordance with the invention only has one engagement spot, the stiffness of the slot or ring does not change, but only from the pile itself during the lowering operation. Since the number of variables in the analysis is reduced, the reliability of the analysis results is also increased.

In the figures, the structure 1 to be lowered is shown in the form of a typical steel jacket. However, the invention finds general application in installing any structure on the seabed or on mainland, when sideways tolerances are of vital importance. Typical examples are, in addition to the illustrated jacket and template, a concrete platform, a protecting structure or an underwater installation on top of a frame or template.

When comparing two actual cases, namely the Oseberg-B Jacket and the Oseberg-II Wellhead Platform, as existing in May 1987, calculations have been made to show a reduction in the tieback moment which can be transformed directly into tolerances, of about 70%. However, it must be noted that lesser parts of this reduction are due to other matters than those related to the invention, namely the use of three piles instead of two. However, on the other hand "as installed" tolerances, i.e. known and certain tolerances were applied regarding Oseberg-B, while in the Oseberg-II calculation example all theoretical uncertainties were taken into consideration, i.e. larger uncertainties. Accordingly, this resulted in a conservative calculation of the reduction in tieback moment.

The invention has been referred to previously in this specification as a "fixed" system (compare the prior art techniques mentioned in the introductory part of the specification). However, variants of the principle according to the invention, i.e. including the ring and slot, may also be constructed starting from the previously mentioned "active" and "passive" systems.

For example, both the slot and ring, or possibly only one of these members, may be constructed to be movable and thereby the effect of these movable systems is achieved. The characteristic feature of the movable systems (active/passive) is that they are able to enclose the docking pile rapidly when the construction has been brought into position, in addition to the fact that the structure is made less sensitive to vertical blows from the docking pile against the guide part of the structure, which docking pile may thrust into the edge under unfortunate circumstances.

Figure 11:
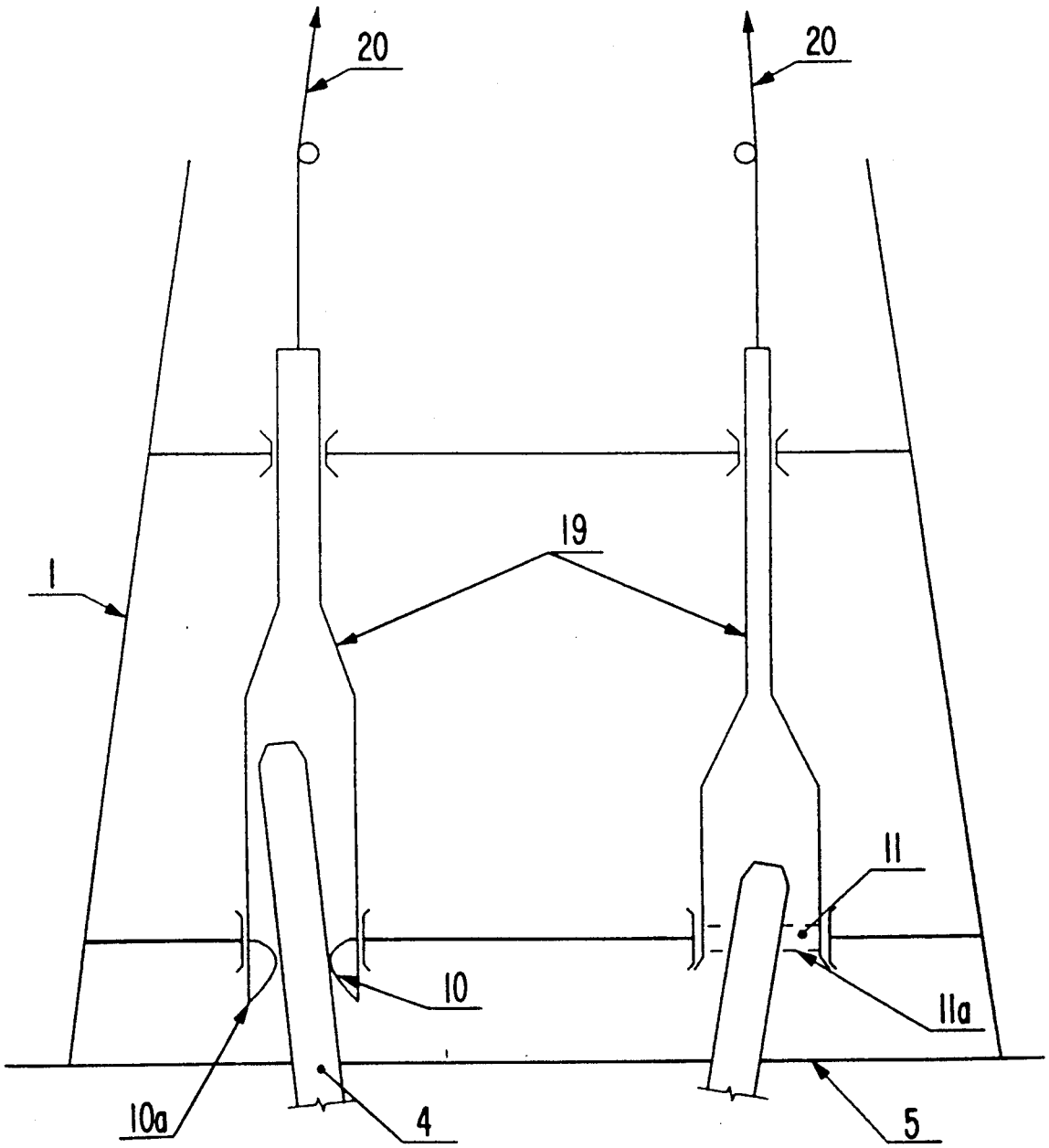
FIG. 11 is a schematic diagram of another embodiment of the present invention.

The slot and the ring in accordance with the present invention may, for instance, be constructed as movable elements simply by placing the previously described directing collars inside a larger cylinder which corresponds to the traditional docking sleeve, whereafter the docking sleeves can be hoisted and lowered as desired. In this connection, FIG. 11 shows docking sleeves 19 which can be lifted up and down by means of wires 20, and where the docking sleeves have directing collars 10*a*, 11*a*, in accordance with the present invention, located inside the docking sleeves.

As previously mentioned, the invention may also be realized by disposing the ring and the slot at different levels in the structure to be lowered, on the condition that the heights of the two piles are adapted to such a situation. As long as the ring can be threaded onto "pile no. 1" first, and thereafter a possibility exists for rotation in order to fit the slot down onto "pile no. 2", the invention will be able to function as intended in this regard. The point is that the guide member and the guide part (i.e. ring or slot) in the final stage are supposed to be located at the same level for each single pile.

Nor are a directing collar/directing skirt for the ring and the slot necessary features per se, but practical additional features of the invention. A corresponding directing effect during the mating operation is also achieved for instance by sharpening or rounding the tops of the docking piles.

What is claimed is:

1. Apparatus for positioning and mounting a large structure to a ground surface, said apparatus comprising:

first and second docking piles fixed in and extending from the ground surface; and guide means fixed to said structure for receiving said docking piles, for forming a guide along which said structure is guidable by said docking piles down to the ground surface, and for securing said structure in a mated position with said docking piles once the structure stands on the ground surface, said guide means comprising a guide ring defining an opening therethrough, and a guide frame defining a substantially rectangular guide slot therethrough, said opening and said guide slot extending in mutually parallel planes, the smallest diameter of said opening matching the outer diameter of said first docking pile, whereby said guide ring is adapted to receive said first docking pile and guide said structure therealong, the shorter side of said substantially rectangular guide slot matching the outer diameter of said second docking pile, and the longitudinal axis of said substantially rectangular guide slot intersecting a line extending perpendicular to said planes and through the center of said opening, whereby said guide frame is adapted to receive said second docking pile and guide said structure therealong.

2. Apparatus as claimed in claim 1, wherein said opening and said guide slot extend in the same plane.

3. Apparatus as claimed in claim 1, wherein said guide ring comprises a collar having an open end facing in the direction of the bottom of said structure, said collar defining said opening therethrough, the opening tapering from said open end in a direction toward the top of said structure.

4. Apparatus as claimed in claim 2, wherein said guide ring comprises a collar having an open end facing in the direction of the bottom of said structure, said collar defining said opening therethrough, the opening tapering from said open end in a direction toward the top of said structure.

5. Apparatus as claimed in claim 1, wherein said guide frame comprises a skirt having an open end facing in the direction of the bottom of said structure.

6. Apparatus as claimed in claim 2, wherein said guide frame comprises a skirt having an opening end facing in the direction of the bottom of said structure.

7. Apparatus as claimed in claim 3, wherein said guide frame comprises a skirt having an open end facing in the direction of the bottom of said structure.

8. Apparatus as claimed in claim 4, wherein said guide frame comprises a skirt having an open end facing in the direction of the bottom of said structure.

9. Apparatus as claimed in claim 1, wherein at least one of said first and said second docking piles has a tapered top end.

10. Apparatus as claimed in claim 1, wherein each of said docking piles has a gimbal fixed thereto.

11. Apparatus as claimed in claim 3, further comprising docking sleeves movably mounted to said structure so as to be raisable and lowerable relative thereto, said sleeves having open lower ends facing in the direction of the bottom of said structure, and wherein said collar and said guide frame are mounted in said docking sleeves, respectively, so as to be raisable and lowerable with the respective said docking sleeves.

12. A method of mounting a large structure to a ground surface, said method comprising:

mounting a comparatively small structure, having guide members, to the ground surface;

forcing first and second docking piles, as guided by the guide members of the small structure, into the ground surface until the piles are secured thereto;

providing a said large structure which has guide means fixed thereto for receiving said docking piles, for forming a guide along which said structure is guidable by said docking piles down to the ground surface, and for securing said structure in a mated position with said docking piles once the structure stands on the ground surface, said guide means comprising a guide ring defining an opening therethrough, and a guide frame defining a substantially rectangular guide slot therethrough, said opening and said guide slot extending in mutually parallel planes, the smallest diameter of said opening matching the outer diameter of said first docking pile, whereby said guide ring is adapted to receive said first docking pile and guide said large structure therealong, the shorter side of said substantially rectangular guide slot matching the outer diameter of said second docking pile, and the longitudinal axis of said substantially rectangular guide slot intersecting a line extending perpendicular to said planes and through the center of said opening, whereby said guide frame is adapted to receive said second docking pile and guide said large structure therealong;

lowering said large structure toward said docking piles, with the opening of said guide ring disposed over said first docking pile, and causing said first docking pile to be received by said guide ring in the opening thereof;

rotating said large structure, with said first docking pile received by the guide ring thereof, by an amount necessary to position the guide frame over said second docking pile;

causing said second docking pile to be received by said guide frame in the substantially rectangular guide slot thereof; and subsequently lowering said large structure, as guided along said docking piles by said guide ring and said guide frame, respectively, until said large structure rests on the ground surface.

* * * * *